US006095070A

United States Patent [19]

Sahl

[11] Patent Number: 6,095,070

[45] Date of Patent: Aug. 1, 2000

[54] DRIVING DEVICE FOR FEEDING MATERIAL TO BE SEWN IN A SEWING MACHINE

[76] Inventor: Johannes Sahl, Tannenweg 17, A-4501 Neuhofen/Krems, Austria

[21] Appl. No.: 09/269,863

[22] PCT Filed: Oct. 6, 1997

[86] PCT No.: PCT/AT97/00213

§ 371 Date: Apr. 1, 1999

§ 102(e) Date: Apr. 1, 1999

[87] PCT Pub. No.: WO98/15678

PCT Pub. Date: Apr. 16, 1998

[30] Foreign Application Priority Data

Oct. 4, 1996 [AT] Austria ..... 1760/96

[51] Int. Cl.[7] ..... D05B 69/02; D05B 69/16

[52] U.S. Cl. ..... 112/220; 112/304; 112/322

[58] Field of Search ..... 112/304, 305, 112/312, 313, 314, 318, 322, 220

[56] References Cited

U.S. PATENT DOCUMENTS 2,678,010 5/1954 Pinkvoss .
4,413,582 11/1983 Landwehr et al. .
4,457,243 7/1984 Bowditch ..... 112/304 X
4,791,877 12/1988 Horie et al. ..... 112/322 X
5,579,708 12/1996 Kambara et al. ..... 112/304 X

FOREIGN PATENT DOCUMENTS 0010703 5/1980 European Pat. Off. .
3447751 A1 7/1986 Germany .
9011178 10/1990 Germany .

*Primary Examiner*—Peter Nerbun
*Attorney, Agent, or Firm*—Collard & Roe, P.C.

[57] ABSTRACT

A drive means for feeding a material to be sewn on a sewing machine (1) includes a feed dog (7) to be coupled to a continuous rotary drive (9) via at least one intermediate drive. To achieve optimum drive conditions in a comparatively simple way, the intermediate drive consists of a belt drive (10) with a belt (13) circulating around a drive wheel (11) and a driven wheel (12), where the belt (13) having an excess length is guided over a control roller (14) at the working portion thereof (131) and over a tension roller (15) at the return portion (132) thereof, and the control roller (14) and the tension roller (15) are mounted so as to be periodically reciprocated in the sense of a release or deflection of the belt (13) for decelerating, stopping and accelerating the rotation of the driven wheel, and the driven wheel (12) is in rotary connection with a feed dog (7) designed as circular conveyor, in particular as conveyor belt (20).

7 Claims, 2 Drawing Sheets

4
5
8
10
12
13
14
16
20
21
22
24
131
231

DRIVING DEVICE FOR FEEDING MATERIAL TO BE SEWN IN A SEWING MACHINE

FIELD OF THE INVENTION

This invention relates to a drive means for feeding a material that may be sewn on a sewing machine, comprising a feed dog to be coupled to a continuous rotary drive by at least one intermediate drive.

DESCRIPTION OF THE PRIOR ART

Sewing machines almost exclusively include feed means for a stepwise feed of the workpiece, so that the material to be sewn stands still during the impingement of the needle, and the feed movement is effected only in that period in which the needle is outside the material to be sewn. These known feeding means mostly consist of a skipping conveyor, where the material to be sewn is seized by a toothed feed dog periodically emerging from the needle plate and is moved forward in the sewing direction. For this purpose, the movement of the feed dog is composed of a lifting movement and a pushing movement, which movements are performed by two special eccentric drives operating independently of each other as intermediate drives. Accordingly, these skipping conveyors require a complicated mechanical drive and transmission elements, requiring suitable maintenance and involving a high susceptibility to failure. In addition, in the case of higher feed rates the lifting movement of the feed dog involves the risk that the material to be sewn might be lifted off the feed dog due to the acceleration, so that the required accuracy of the feed of the material to be sewn is lost, and the feed rate and thus the sewing speed must remain restricted.

In accordance with DE 34 47 751 A there has also already been proposed a fabric feeding accessory which comprises a belt driven in feed direction via deflection rollers, where the belt driven continuously by means of a rotary drive drives a pressing device pressed onto the layer of fabric behind the needle in the feed direction, and is guided by a roller of the pressing device and a tension roller fixed on a spring-loaded lever in the tension line of the belt, and when the tensile stress of the belt, which is predetermined by the spring-loaded lever, is exceeded, the belt is loosened by the tension roller to such an extent that its feed can come to a standstill, so that an intermittent operation is possible. However, this feed means is exclusively used as an accessory for usual means for feeding material to be sewn and is designed to effect a transport of the material to be sewn without displacement. For this purpose, the belt of the accessory merely drives the pressing roller intermittently and synchronized with the stepwise feed of the material to be sewn. It can, however, not replace the feed of the material to be sewn, but can only support the same subsequently.

It is therefore the object of the invention to create a drive means as described above, which in a relatively simple and inexpensive way allows to perform an intermittent feed of the material to be sewn as a pure pushing movement without lifting component, and in addition derives this pushing movement from a continuous rotary movement.

SUMMARY OF THE INVENTION

This object is accomplished by the invention with an intermediate belt drive including a belt revolving around a drive wheel and a driven wheel, the belt having an excess length and its working position being guided over a control roller while its return portion is guided over a tension roller. The control roller and the tension roller are mounted so as to be reciprocated periodically tranversely to the direction in which the belt revolves to release or deflect the belt for decelerating, stopping and accelerating the rotation of the driven wheel. The drive wheel is in rotary connection with a feed dog designed as a circular conveyor, in particular as a conveyor belt. Due to the belt drive, which is preferably designed as a toothed belt drive, but might also be designed as V-belt, flat-belt, rope or chain drive or the like, the driven wheel is rotated in a certain transmission ratio by the drive wheel, while the control and tension rollers are standing still, and via corresponding drive connections can transmit its rotary movement to the conveying means to be driven. But when the control roller is adjusted from a basic position, in which the belt undergoes a deflection between drive wheel and driven wheel due to its excess length, such that the deflection is reduced, the pulling drive movement of the belt is absorbed by the uniform rotation of the drive wheel to the extent of the release of the belt, so that the driven wheel is decelerated in its rotation and even stopped with a correspondingly adapted transverse adjustment of the control roller. Along with the yielding of the control roller, the tension roller ensures a uniform tension of the belt on the side of the return portion due to an increasing deflection of the belt and ensures a perfect guidance of the belt. A periodic reciprocation of the control roller and of the tension roller and the related increasing or decreasing deflection of the belt in the working portion and also on the return portion thus influences the rotary movement of the driven wheel in the sense of a deceleration and stopping or during the readjustment in the sense of an acceleration, and the circular conveyor designed as feed dog coupled with this driven wheel also performs this rotary movement or conveying movement and is likewise periodically decelerated or stopped or accelerated, which in a simple way creates an intermittent feed. As circular conveyor, there might in principle be used a feed wheel or a feed roller or a similar rotating element, but optimum feed conditions are obtained with a conveyor belt, as by means of suitable deflection rollers the conveyor belt allows to form certain rectilinear conveying lines, which ensure an exact linear feed. As rotary connection all kinds of transmissions, shafts and the like can be used, preferably also belt drives, which transmit the rotary movement of the driven wheel to a drive wheel of the feed dog conveyor belt and allow an arrangement of the rotary drive and the intermediate drive spaced from the feed dog at a favorable place in the machine area. The conveying speeds can now be chosen independent of possible lifting accelerations of the material to be sewn or of the work-piece, where the frequency of the feed steps and the respective step lengths depend on the frequency of the transverse adjustment of the control roller and the rotational speed of the belt drive, so that there is a maximum freedom as regards the control of the conveying movement. Since there is no lifting component in the feed step, such drive means is optimally suited for simultaneously driving two feed dogs cooperating in pairs, which feed dogs exactly guide the workpiece between each other and ensure optimum feed conditions also for two or more workpieces lying one above the other.

The control roller might actually be seated on a carriage or the like, which is guided so as to be transversely movable, but the control roller is expediently mounted on a control lever pivotally mounted about a swivel axis parallel to the drive wheel axis, so that the transverse adjustment can be achieved as a swivel movement, which can easily be varied by changing the lever conditions.

It is particularly advantageous if the control lever is pivotally mounted about a swivel axis coaxial with respect to the drive wheel axis and in addition to the control roller also carries the preferably resiliently supported tension roller. As a result, control roller and tension roller move on concentric circular arcs around the drive wheel axis, so that the deflection and release movements of the control roller and the tension roller are identical, and a perfect guidance of the belt is possible. Occurring differences in the length of the working portion and of the return portion can be compensated by a resilient support of the tension roller without influencing the elasticity of the belt.

In accordance with a particularly advantageous aspect of the invention a differential feed dog consisting of two conveyor belts is provided as feed dog, where the two conveyor belts are in drive connection with each other via a belt drive, whose belt having an excess length is in turn guided over a periodically transversely adjustable control roller or tension roller in the working portion and in the return portion. The two conveyor belts of the differential feed dog are disposed before and behind the needle or the processing point in the feed direction and allow a feed of the workpiece guided on each side of the processing point. The speed of the two conveyor belts can be changed relative to each other, so that during the sewing operation the material to be sewn is either pushed together and gathered or pulled apart and stretched. Due to the drive connection of the two conveyor belts by a belt drive to be influenced by means of a control roller or a tension roller it is now easily possible to influence the conveying speeds of the two conveyor belts as desired and for instance stretch the material to be sewn also during the needle impingement, in order to compensate the thread tension applied while binding the thread, and to achieve an optimum sewing quality. Here as well, the design of the differential feed dog with two conveyor belts ensures perfect feed lines and optimum guiding conditions during the sewing operation, and of course the conveyor belts can also be arranged in pairs one above the other, and the like.

A constructively simple possibility for adjusting the control roller and the tension roller is obtained when the control roller forms an eccentric with an eccentric shaft rotatable and movable about an axis of rotation parallel to the belt drive wheel axes, and the tension roller is seated on a spring-loaded swivel arm, so that a rotary speed of the eccentric adapted to the number of stitches leads to a corresponding deflection of the working portion and thus ensures the desired effect of the differential feed dog, where the spring-loaded swivel arm continuously presses onto the return portion of the belt and ensures the required belt tension.

BRIEF DESCRIPTION OF THE DRAWING

In the drawing, the subject-matter of the invention is illustrated in detail with reference to an embodiment, wherein.

DESCRIPTION OF THE PREFERRED EMBODIMENT

Figure 2:
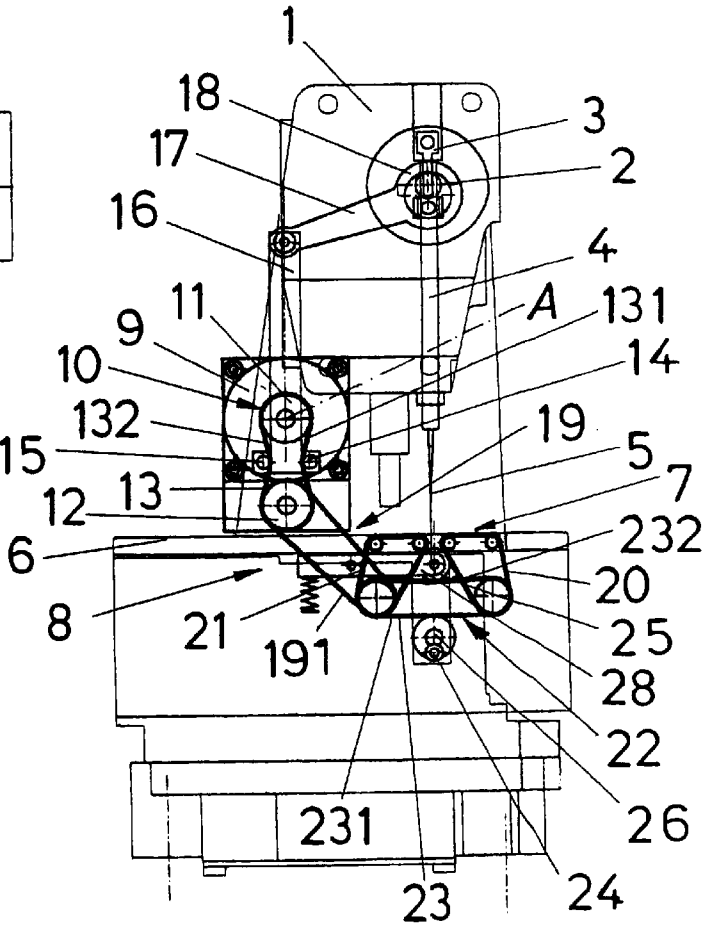
FIGS. 1 and 2 show a sewing machine with a drive means as feed means according to the invention in a schematic side view and in an end view.
Figure 1:
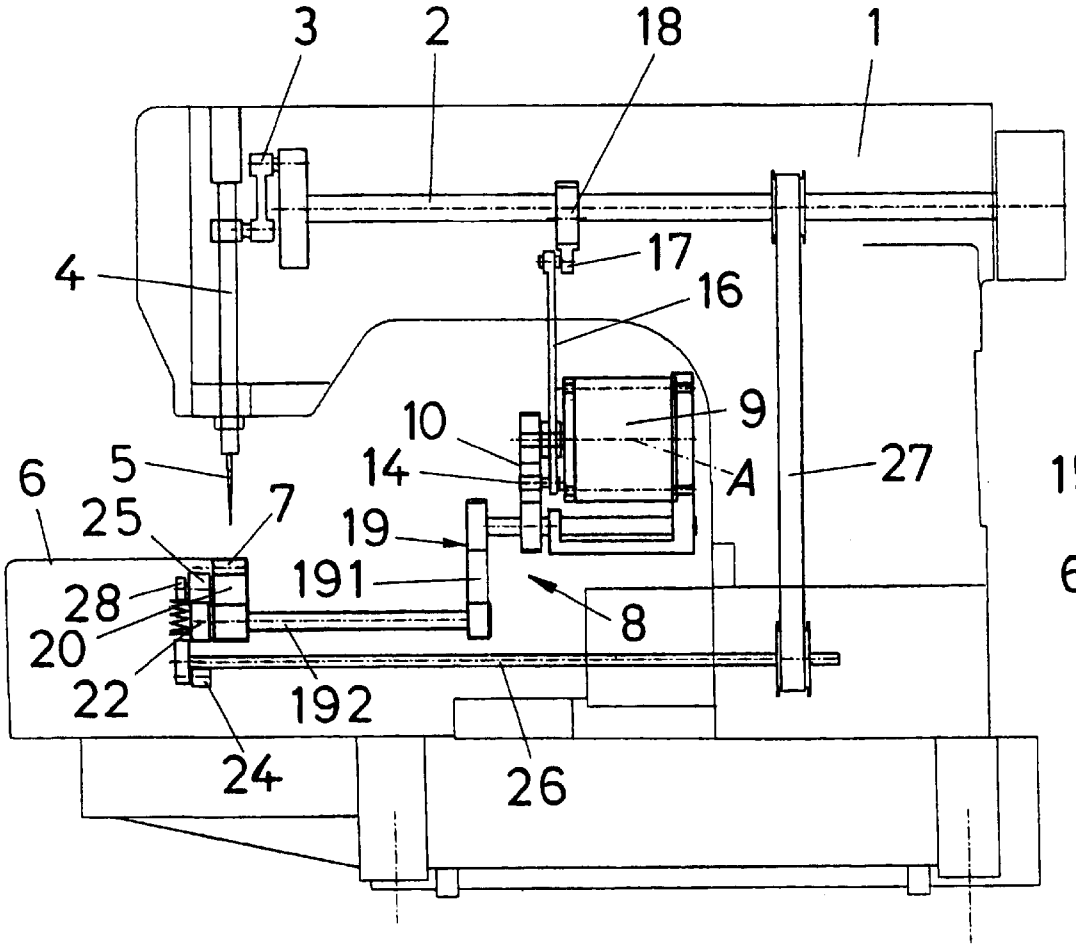

A sewing machine 1 includes a crank drive 3 for the needle bar 4, which crank drive can be driven via an upper drive shaft 2, and the needle 5 inserted in the needle bar at the lower end thereof. At the needle plate 6 there is provided a feed dog 7 of a feed means 8 for an intermittent feed of the material to be sewn.

The drive for the feed means 8 is derived from a rotary drive 9 comprising an electric motor, which rotary drive is coupled with the feed dog 7 by intermediate belt drive 10. The belt drive 10 consists of a drive wheel 11 driven by a rotary drive 9, a driven wheel 12 and a belt 13 having an excess length. The working portion 131 of the belt 13 is guided over a control roller 14, and the return portion 132 is guided over a tension roller 15. Control roller 14 and tension roller 15 are supported on a control lever 16, which can be swivelled about an axis extending coaxially with respect to the axis A of the drive wheel 11, and can be periodically reciprocated transversely to the direction of the belt circulation by means of the control lever 16. For this purpose, an adjusting lever 17 of an eccentric drive 18 seated on the upper drive shaft 2 engages the control lever 16.

The driven wheel 12 is in turn in drive connection with the feed dog 7 via a rotary connection 19 consisting of belt drive 191 and connecting shaft 192, so that the rotary movement of the driven wheel 12 is proportionally transmitted to the feed dog 7 in a predetermined transmission ratio.

The feed dog 7 is designed as a differential feed dog and comprises two conveyor belts 20, 21 disposed one behind the other, which in turn are in drive connection with each other via a belt drive 22. To control the relative speeds of the two conveyor belts 20, 21, this belt drive 22 like the belt drive 10 has a belt 23 of excess length, which in the working portion 231 cooperates with a control roller 24 and of the return portion 232 cooperates with a tension roller 25. In this case, the control roller 24 forms an eccentric, which is rotatably and drivably seated on a lower eccentric shaft 26, which in turn is in drive connection with the upper drive shaft 2 via a belt drive 27. The tension roller 25 is supported on a spring-loaded swivel arm 28 and due to the spring load provides a permanent tension of the belt 23 independent of the position of the control roller 24.

Due to the belt drive 10 it is possible to superimpose an additional belt movement on the continuous rotary movement of the drive wheel 11 as a result of the cooperation of the control and tension rollers 14, 15 with the belt 13 of a suitable excess length, so that the belt movement driving the driven wheel 12 effects a deceleration, stopping and acceleration of the movement of the driven wheel. When a swivel movement of the control lever 16 effects a transverse adjustment of the control roller 14 in the sense of a release of the belt 13, and the belt tension is maintained via the tension roller 15, the rotary movement of the driven wheel 12 will be interrupted during this release, and during a return movement in the sense of another deflection of the belt 13 an accelerated rotary movement will take place, so that an intermittent drive movement is transmitted from the driven wheel 12 via the rotary connection 19 to the feed dog 7. This intermittent drive movement is performed by the conveyor belts 20, 21 of the feed dog 7, so that the desired stepwise feed of the material to be sewn is effected during the sewing operation. Due to the drive connection of the two conveyor belts 20, 21 by means of the belt drive 22, whose transmission effect can likewise be influenced by means of the control roller 24 and the tension roller 25, an additional decelerating and accelerating component can be superimposed on the proportional drive connection, so that the two conveyor belts 20, 21 are periodically rotating at different speeds so that the material to be sewn will be stretched or pushed together during the sewing operation, depending on whether a smooth or a gathered seam is desired.

Figures 3, 4, 5, 6:
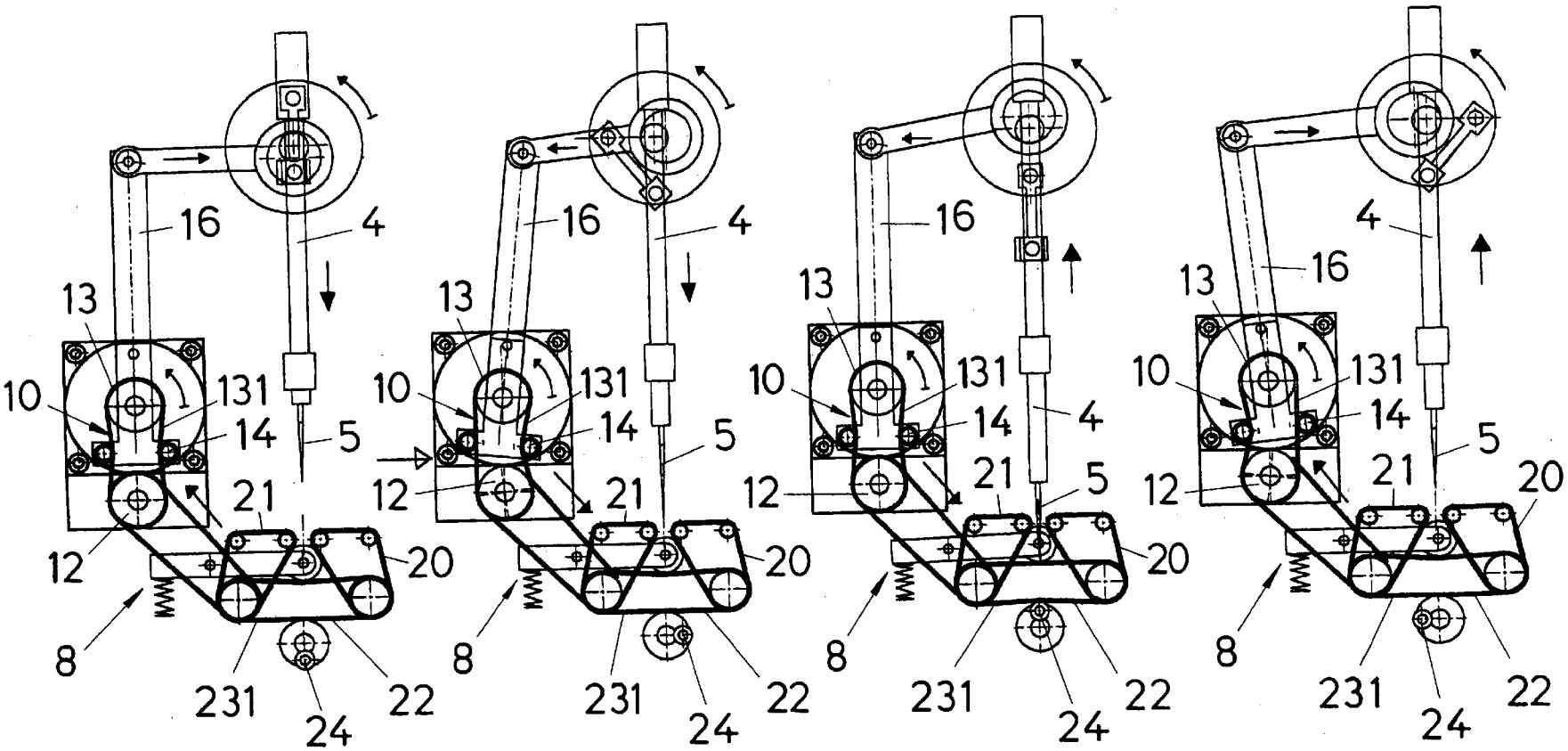
FIGS. 3 to 6 represent the drive means in four operating positions.

Since the control drives are derived from the needle movement of the sewing machine, needle stroke and feed movement are synchronized correspondingly, which can be:

Seen in FIG. 3, the needle bar 4 is in the upper dead center, and the belt drive 10 is in a central position with the same belt deflection in the working portion and in the return portion. The two conveyor belts 20, 21 are synchronously connected via the belt drive 22, as the control roller 24 is lifted off the working portion 231. As the drive movement proceeds, the needle bar 4 is lowered as shown in FIG. 4, and at the same time the control lever 16 is swivelled in the sense of an increased belt deflection of the belt drive 10 the working portion 231, which leads to an accelerated rotary movement of the driven wheel 12 and thus to the feed movement caused by the conveyor belts 20, 21. The conveyor belts 20, 21 are still revolving synchronously. During the impingement of the needle 5 between the conveyor belts 20, 21, the control lever 16 is swivelled back, and the working portion 131 of the belt 13 is released by the yielding control roller 14, which after a corresponding deceleration leads to a stopping of the driven wheel 12 and also effects a standstill of the conveyor belt 21. As can be seen in FIG. 5, the working portion 231 of the belt drive 22 is now deflected at the same time by the control roller 24, so that there is effected a relative movement of the conveyor belt 20 with respect to the standing conveyor belt 21 in the sense of a stretching of the material to be sewn, which involves a perfect guidance of the stitches by compensating the thread tension in the workpiece. Having passed through the bottom dead center, the needle bar 4 will move up again and withdraw the needle 5 from the material to be sewn, and swivelling back the control lever 16 at the same time leads to an increased deflection of the belt 13 in the belt drive 10 and thus to an acceleration of the driven wheel 12 and thus of the feed, whereas by lifting off the control roller 24 the belt drive 22 again ensures a synchronous drive movement for the two conveyor belts 20, 21, as is indicated in FIG. 6. In the case of a further drive movement there will in turn be effected a descending stroke of the needle, as shown in FIG. 3 etc.

The feed means 8 in accordance with the invention is characterized by its particularly simple intermittent drive, which can be controlled within wide ranges and involves a linear conveying movement for the material to be sewn and provides the condition for a perfect guidance of the material to be sewn virtually independent of the number of stitches and the stitch size.

What is claimed is:

1. A drive means for feeding a material to be sewn on a sewing machine, which comprises (a) a feed dog, (b) a continuously rotatable rotary drive, and (c) an intermediate belt drive coupling the feed dog to the rotary drive, the intermediate drive comprising (1) a belt, (2) a drive wheel rotatable by the rotary drive, and (3) a driven wheel, the belt revolving around the wheels and having an excess length, a working portion of the belt leading from the drive wheel to the driven wheel and a return portion of the belt leading from the driven wheel back to the drive wheel, and the driven wheel being in rotary connection with the feed dog, (4) a control roller guiding the working portion of the belt, and (5) a tension roller guiding the return portion of the belt, the control roller and the tension roller being mounted for periodic reciprocation transversely to the direction in which the belt revolves to release and deflect the belt for decelerating, stopping and accelerating the rotation of the driven wheel.

2. The drive means of claim 1, wherein the revolving conveyor is a conveyor belt.

3. The drive means of claim 1, further comprising a control lever carrying the control roller, the control lever being pivotally mounted about a swivel axis extending parallel to an axis of the drive wheel.

4. The drive means of claim 3, wherein the swivel axis and the drive wheel axis are coaxial, and the control lever also carries the tension roller.

5. The drive means of claim 4, wherein the tension roller is resiliently supported on the control lever.

6. The drive means of claim 1, wherein the feed dog is a differential feed dog comprising two revolving conveyor belts, the two conveyor belts being in drive connection with each other by a drive belt having an excess length, a control roller guiding a working portion of the drive belt and a tension roller guiding a return portion of the drive belt, the control roller and the tension roller being mounted for periodic adjustment transversely to the direction in which the drive belt revolves.

7. The drive means of claim 6, wherein the control roller guiding the working portion of the drive belt forms a cam and has an eccentric shaft, the drive belt revolving about drive wheels and the eccentric shaft being rotatable about an axis of rotation extending parallel to axes of rotation of the drive wheels, and the tension roller guiding the return portion of the drive belt is seated on a spring-loaded swivel arm.

* * * * *